United States Patent [19]

Mampaey

[11] 4,061,103

[45] Dec. 6, 1977

[54] TOWING HOOK

[75] Inventor: Johannes Josephus Mampaey, Dordrecht, Netherlands

[73] Assignee: Machinefabriek Mampaey Marine Engineering B. V., Dordrecht, Netherlands

[21] Appl. No.: 708,620

[22] Filed: July 26, 1976

[51] Int. Cl.[2] ..... B63B 21/60

[52] U.S. Cl. ..... 114/252; 294/84

[58] Field of Search ..... 114/249–252, 114/230; 280/504, 508; 294/82 R, 84, 83 R, 83 AB

[56] References Cited

U.S. PATENT DOCUMENTS 3,575,459 4/1971 Coblenz ..... 294/83 R

FOREIGN PATENT DOCUMENTS 1,130,071 10/1968 United Kingdom ..... 114/252

905,979 9/1962 United Kingdom ..... 114/252

*Primary Examiner*—Trygve M. Blix

*Assistant Examiner*—Jesus D. Sotelo

*Attorney, Agent, or Firm*—O'Brien & Marks

[57] ABSTRACT

A towing hook device having a lockable towing hook, use being made for locking of a pivoting pin which has been unilaterally recessed, there being disposed adjacent the recess a drop-shaped body such that the end of a blocking arm of the towing hook causes the blocking pin to execute a forced movement between a blocking position and a release position, the blocking pin in the blocking position being retained by a pawl.

2 Claims, 5 Drawing Figures

30

TOWING HOOK

The present invention relates to a towing hook device such as for mooring or towing a vessel, provided with a towing hook swivelling in a frame about a towing hook shaft, having at least one blocking member mounted pivotally in the frame, for blocking the towing hook in a towing position, there being provided a pawl means for locking the blocking member, while said blocking member is movable between a blocking position and release position, while in the blocked towing position one end of a blocking arm of the towing hook abuts against a stop surface of the blocking member.

By operating the blocking member of such device the towing hook can be released, whereafter, through some hand movements, the towing hook has again to be returned to the towing position and blocked therein.

It is an object of the invention to provide a simplified device of the above type.

To this effect according to the invention the blocking member is designed as a blocking pin, wherein the shaft of said pin is locally reduced for forming the blocking stop for the end of the blocking arm of the towing hook, while adjacent the reduced part of the shaft of the blocking pin there is disposed a drop-shaped or comma-shaped body which coacts with the end of the blocking arm for returning the blocking pin to the blocking position, while furthermore the blocking pin is provided with at least one pin-concentric locking disc with location for the locking pawl, while there is mounted in the frame a boundary plate which coacts in the release position with a corresponding boundary face at the blocking pin, whereby the locking pawl is biased against the locking disc.

One embodiment of the invention will now be described, by way of example, with reference to the accompanying drawings wherein.

Figures 1, 2, 3, 4:
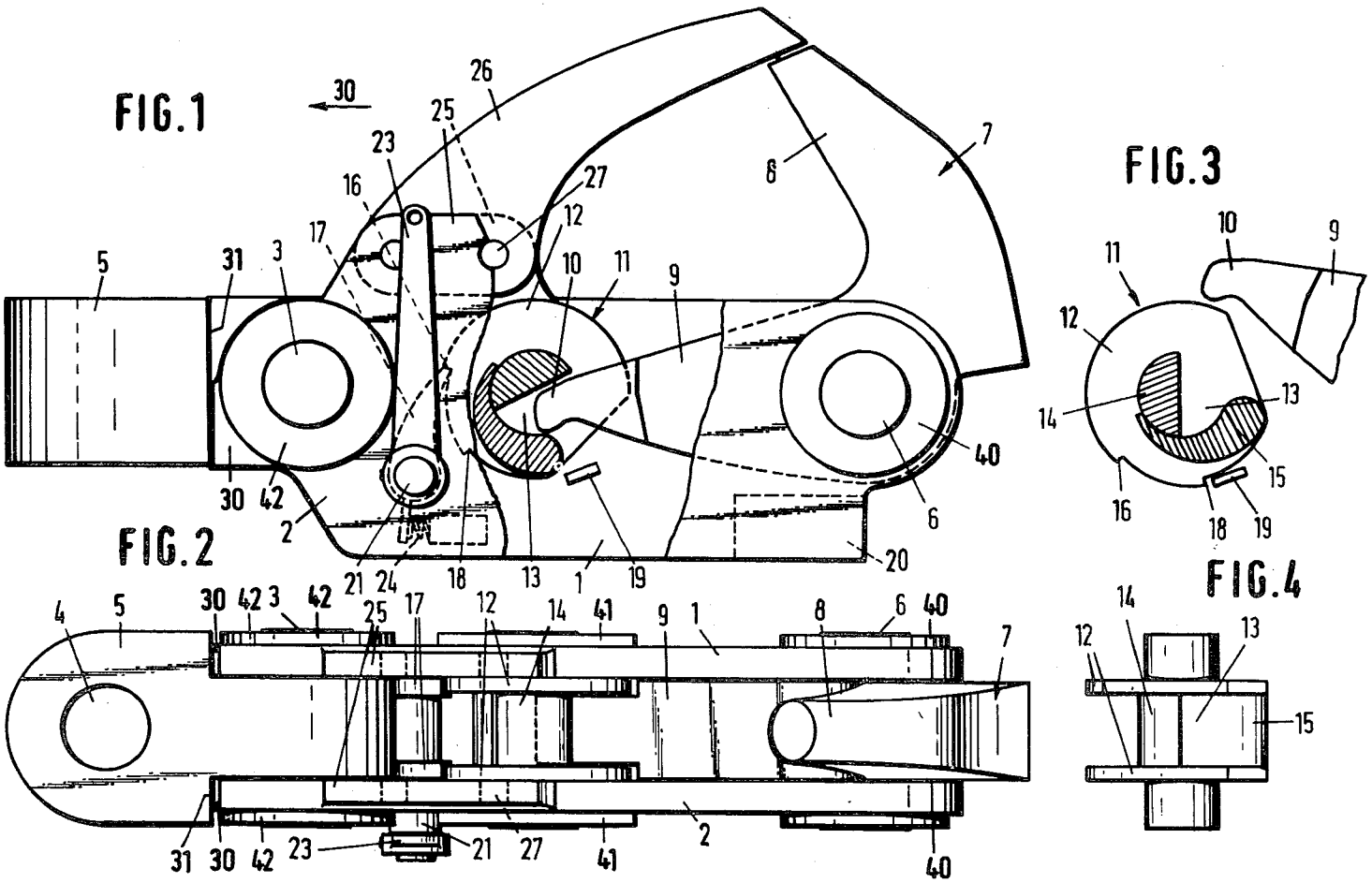
FIG. 1 shows in side view, partly in cross section, a towing hook according to the invention.
FIG. 2 shows a top view according to FIG. 1.
FIGS. 3 and 4 show further particulars of the blocking pin and FIG. 5 shows a variant embodiment according to FIG. 2.

The towing hook shown in the drawing comprises two parallel body plates 1 and 2, which are pivotably connected at one end by means of a horizontal pin 3 to a connection piece 5 having a vertical bore 4, which piece, in its turn, is adapted for pivotal attachment about a vertical pin, not shown, such as on a towboat, ashore, a mooring buoy or the like; also a combination with a capstan is possible.

At the other end the two body plates 1 and 2 are connected through a pin or shaft 6 whereon is mounted a towing hook generally indicated by 7. Said hook comprises an upper hook portion 8, wherebehind can be hooked a towing cable, a mooring hawser or the like, as well as a blocking arm 9. The end 10 of the blocking arm is adapted for coaction with a blocking member or pin generally indicated by 11, which pin 11 is pivotally mounted relative to the two body plates 1 and 2, and comrising two partly circular side plates or locking discs 12, as well as a central eccentric shaft portion 14 reduced on one side to form a recess 13 such that in the center only half the pin remains at 14. Opposite the end 10 of the blocking arm 9 there is mounted an eccentric comma-or drop-shaped guide member 15 which closes the recess 13 on one side. The two side plates 12 are each provided with a location or latching projection 16 for a pawl 17 and with a boundary face or limit projection 18. Between the two body plates 1, 2 there is mounted a boundary plate or limit stop 19 whereagainst abuts the boundary face 18 of the locking discs 12 in a release position of the blocking pin to prevent rotation past the release position. A stop for the towing hook 8 in the released position is indicated by 20. Furthermore there is mounted a locking shaft 21 in the two body plates 1, 2. On said locking shaft are secured the two locking pawls 17. In the blocking position said pawls 17 coact with the pawl locations 16 for retaining the blocking pin 11. At one end of the pin 21 there is mounted an operating lever 23, while furthermore there is provided a return spring 24 urging the locking pin 21 with the blocking pawls 17 towards the locking position. Furthermore there are disposed on top of the body plates 1, 2 lugs 25 wherein is mounted a closing arm or hawser protection device 26. Moreover there is provided a through-bore 27 for locking said hawser protection device 26.

In the locked blocking position a pulling force exerted on the towing hook arm 8 will be inclined to lift the end 10 of the blocking arm 9. This is prevented however by the solid portion 14 of the blocking pin 11, a movement of torsion being exerted on said pin. However, the pin cannot rotate since it is retained by the pawls 17. By moving the arm 23 in the direction of the arrow 30, the pawls 17 are released, whereafter under influence of the pull force of the tow rope, the blocking pin 11 can execute a swivelling movement in the direction of arrow 30 so that the end 10 is released from the tow hook and the towing hook will rotate over approx. 90°. The blocking pin 11 swivels only so far until the boundary face 18 abuts against the boundary plate 19. This is shown in FIG. 3; FIG. 4 depicts a top view of the blocking pin. In this position the blocking pin 11 is retained as a result of the frictional forces exerted by pawls 17 under influence of the return spring 24. There may be applied a spring for maintaining the blocking pin in this position.

Upon return of the hook 7 in the active pulling position, it is brought again in the position indicated by 8 and shown in FIG. 1, during which the end 10 of the blocking arm 9 moves downwardly, there abutting against the rounded front end of the guide member 15. Under influence thereof, the pin 11 is subjected to a swivel-back movement in a direction opposite to arrow 30 as far as the position drawn by full lines, the pawls 17 coming to lie again in their locations 16. By means of a very simple movement therefore the towing hook can be returned to the active towing or dragging position. It will be clear that this return movement need not be effected necessarily by hand but that also a mechanical, electrical or pneumatical operation is possible. Also for the operation of the lever 23 remote control may be employed. The hawser protection device 26 is only mounted insofar this is desirable to prevent an unintended pulling away of a tow rope in upward direction.

It is observed that FIGS. 1 and 2 show stops 30 of body plates 1 and 2 at the lower corners beyond the pivot 3. Through said stops 30 the body plates rest against a flat stop surface or face 31 at the connection piece 5. The stops 30 prevent the towing hook from swivelling downwardly and e.g. from coming to rest on the ground, which may result in additional wear. In the position shown in FIG. 1, the centerlines or axes of the pivots 3 and 6 lie substantially in the same horizontal plane. It has been established in practice that the pivot 6 may have a slightly lower position but at most so far that the joint surface across the centerlines of the pivot 6 and of the blocking pin 14 deviates maximally 10° from a horizontal plane. An advantage of such stop against the connection piece 5 is likewise that when it is required to electrically isolate the towing hook, it will be sufficient to isolate the vertical pin whereon the connection piece 5 with bore 4 is mounted relative to the surroundings and that no additional isolation is required adjacent the lower end of the towing hook itself, e.g. in proximity to the portion indicated by 20.

Figure 5:
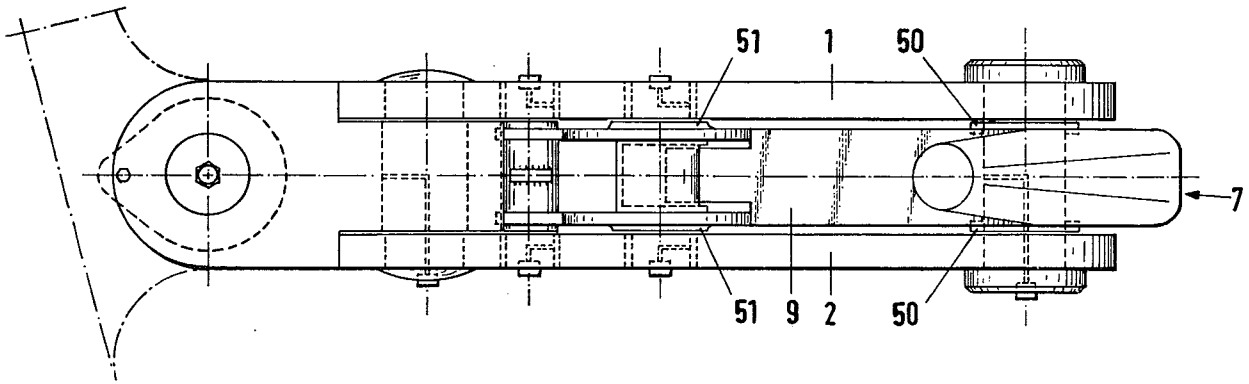

FIG. 5 shows a simplification of body plates 1, 2. Whereas according to FIG. 2 the body plates are relatively thin, enlarged locations 40, 41 or 42 being welded onto the body plates, according to FIG. 5 the body plates are even thicker so that it will be sufficient to simply drill cylindrical holes for the various pivoting pins without welding operations being required therefor. To prevent the towing hook 7, respectively the blocking arm 9 thereof, from contacting the body plates, there are disposed on either side on pin 6 between towing hook and body plate, spacer sleeves 50. For analogous reasons the blocking pin 11 is provided with enlarged portions 51.

I claim:

1. A towing hook device such as for mooring or towing a vessel comprising a frame;

a towing hook mounted in the frame pivotally about a first axis and having a blocking arm with one end thereof extending from the first axis;

a blocking member mounted in the frame pivotally about a second axis and having a shaft portion reduced on one side to form an eccentric blocking step which, when the blocking member is in a blocked towing position, abuts the one end of the blocking arm and which, when the blocking member is in a release position, releases the blocking arm and towing hook;

said blocking member also including an eccentric drop-shaped or comma-shaped body mounted adjacent the reduced side of the shaft portion for co-acting with the one end of the blocking arm when the blocking member is in the release position to return the blocking member to the blocked towing position;

further said blocking member including at least one concentric locking disc having a latch projection and a limit projection;

pawl means including biasing means for engaging the latching projection to latch the blocking member in the blocked towing position; and limit stop means mounted on the frame for engaging the limit projection to prevent movement of the blocking member past the release position.

2. A towing hook device according to claim 1 wherein the first and second axes are horizontal axes, and the frame includes body plates having ends spaced apart from the towing hook, the ends of the body plates provided with stops at the lower corners; and including a connection piece mounted pivotally about a third horizontal axis to the body plates and having a corresponding face for abuttment against the stops on the ends of the body plates, said connection piece having a vertical mounting bore; and wherein the first and second axes define a plane deviating maximally downwardly from the blocking member to the towing hook 10° from a horizontal plane.

* * * * *